US008914937B2

(12) United States Patent
Haan

(10) Patent No.: US 8,914,937 B2
(45) Date of Patent: Dec. 23, 2014

(54) HINGE ASSEMBLY FOR STEAM CLEANER

(76) Inventor: Gyung Hee Haan, Seoul (KR)

( * ) Notice: Subject to any disclaimer, the term of this patent is extended or adjusted under 35 U.S.C. 154(b) by 521 days.

(21) Appl. No.: 13/199,640

(22) Filed: Sep. 2, 2011

(65) Prior Publication Data

US 2012/0227216 A1 Sep. 13, 2012

(30) Foreign Application Priority Data

Sep. 6, 2010 (KR) ..... 10-2010-0086907

(51) Int. Cl.
*A47L 7/00* (2006.01)
*A47L 13/254* (2006.01)
*A47L 13/22* (2006.01)

(52) U.S. Cl.
CPC ..... *A47L 13/225* (2013.01); *A47L 13/254* (2013.01)
USPC ..... 15/320; 15/322

(58) Field of Classification Search
USPC ..... 15/320, 144.1, 145, 147.2, 172, 411, 15/228
See application file for complete search history.

(56) References Cited

U.S. PATENT DOCUMENTS

| | | | | |
|---|---|---|---|---|
| 2,796,619 | A * | 6/1957 | Hammer | 15/172 |
| 3,082,456 | A * | 3/1963 | Short | 15/147.2 |
| 8,091,169 | B2 * | 1/2012 | Jeutter et al. | 15/41.1 |
| 2005/0235446 | A1 * | 10/2005 | Eggers | 15/220.1 |
| 2007/0079470 | A1 * | 4/2007 | Rippl et al. | 15/320 |

* cited by examiner

*Primary Examiner* — Robert Scruggs
(74) *Attorney, Agent, or Firm* — Zuber Lawler & Del Duca LLP

(57) ABSTRACT

This invention relates to a hinge assembly for a steam cleaner capable of pivoting in front/rear (X) and left/right (Y) directions, and more particularly, to a hinge assembly for a steam cleaner capable of being adjusted automatically in a straight direction after a swerving force is removed, when a base assembly was swerved while locking automatically a left/right directional pivoting action.

4 Claims, 11 Drawing Sheets

HINGE ASSEMBLY FOR STEAM CLEANER

RELATED APPLICATIONS

The present invention claims priority from Korean patent application number 10-2010-0086907, filed in the Korean Patent Office on Sep. 6, 2010, which is hereby incorporated by reference in its entirety.

FIELD OF THE INVENTION

This invention relates to a hinge assembly for a steam cleaner capable of pivoting in front/rear (X) and left/right (Y) directions, and more particularly to a hinge assembly for a steam cleaner capable of being adjusted automatically in a straight direction after a swerving force is removed, when a base assembly was swerved while locking automatically a left/right directional pivoting action.

BACKGROUND OF THE INVENTION

In general, a hinge assembly used for a steam cleaner can be pivoted in front/rear and left/right directions. In this case, a front/rear directional pivoting action aids to push or pull a push stick assembly in slightly laid state, and a left/right directional pivoting action allows a base assembly with a pad to be swerved in a degree when it bumps against a corner or other things (for example, table's leg).

When the steam cleaner is not used, the push stick assembly is stood perpendicularly or in close to the perpendicular, and locked with a fixing member such that it cannot be pivoted in front/rear directions.

The fixing member can lock said front/rear directional pivoting action. If the fixing member is used, it is releasably fitted in a base assembly.

Hence, the fixing member should be unlocked or locked each time when the steam cleaner is used or not used. This work is very annoying.

In particular, the fixing member is unlocked during the use of steam cleaner. Therefore, since the push stick assembly tends to swerve in left/right directions when pushing or pulling it in a straight direction, a user may feel inconvenient.

In addition, since the left/right directional pivoting action is performed only along a left and right pivoting center axis, when base assembly 100 is swerved at the angle of θ to push stick assembly 300 as shown in FIG. 11, the base assembly is maintained at θ angle even if the push stick assembly is pulled back. Therefore, a user has to swerve base assembly 100 or push stick assembly 300 such that they are in line, and this work is very annoying.

Moreover, a conventional steam cleaner is primarily used to clean a wooden floor or a carpet (in some case, there is a tray to prevent a pad attachment protrusion (so-called Velcro) from being caught by a carpet when using a steam cleaner). Indeed, when cleaning floors of hard materials such as tile using such steam cleaner, smudged stains may not be cleanly removed since a pad-type cleaning cloth is only used, but a brush is not used.

SUMMARY OF THE INVENTION

This invention has been invented to solve the aforementioned problem. Therefore, the object of this invention is to provide a hinge assembly for a steam cleaner, characterized in that a left/right directional pivoting action of the steam cleaner is locked at ordinary times, but the steam cleaner is automatically pivoted in left/right directions when any external force is applied.

In order to achieve the aforementioned object, according to Claim 1 of this invention, it is provided a hinge assembly for a steam cleaner comprising:

a first member fitted in a base assembly and having a front and rear pivoting center axis which supports to be pivoted in front/rear directions; a second member fitted in a push stick assembly; a left and right pivoting center axis member having a left and right pivoting center axis by which the second member is supported to be pivoted in left/right directions relative to the first member; and an eccentric member fitted in parallel eccentrically to the left and right pivoting center axis;

wherein the left/right directional pivoting action of the steam cleaner is locked by the eccentric member when the first and second members are in line in a longitudinal direction, and the left/right directional pivoting action is allowed when an external force is applied to the locked state, and the locked state is unlocked.

According to Claim 2 of this invention, it is provided a hinge assembly for a steam cleaner:

wherein the eccentric member comprises a locking hole formed in the first member; a left and right pivotable groove connected to the locking hole; a locking piece fitted slidably in the second member; and an elastic portion imparting elasticity to the locking piece.

According to this constitution, the locking piece is locked in the locking hole at ordinary times, but the locking piece leaves for the left and right pivotable groove when an external force is applied, to allow the left/right directional pivoting action, thereby enabling an automatic lock and unlock.

According to Claim 3 of this invention, it is provided a hinge assembly for a steam cleaner:

wherein the left and right pivotable groove may preferably be inclined downwardly toward the locking hole.

According to this constitution, when the external force by which the base assembly is pivoted in left/right directions is removed (i.e., pulling back), the base assembly is automatically swerved in a straight direction instantly the locking piece is automatically guided to the locking hole and locked therein.

According to Claim 4 of this invention, it is provided a hinge assembly for a steam cleaner comprising:

a first member fitted in a base assembly and having a left and right pivoting center axis which supports to be pivoted in left/right directions; a second member fitted in a push stick assembly; a front and rear pivoting center axis member having a front and rear pivoting center axis by which the second member is supported to be pivoted in front/rear directions relative to the first member; and an eccentric member fitted in parallel eccentrically to the left and right pivoting center axis;

wherein the front/rear directional pivoting action of the steam cleaner is locked by the eccentric member when the first and second member are in line in a longitudinal direction, and the front/rear directional pivoting action is allowed when an external force is applied to the locked state, and the locked state is unlocked.

As can be clearly seen from the above description, a preferable embodiment of this invention will exhibit the following effect.

The hinge assembly for a steam cleaner according to this invention has the eccentric member which is coupled and fitted in parallel eccentrically to the left and right pivoting center axis. Hence, when the first and second members are in line in a longitudinal direction, the left/right directional pivoting action is locked, and it is very convenient in cases such as pushing the steam cleaner in front/rear directions or keeping it in standing. When an external force is applied to the locked state, the left/right directional pivoting action is automatically unlocked and allowed such that the base assembly can be swerved in a degree when it bumps an obstruction, and it is very convenient during the use of steam cleaner.

Further, since the left and right pivotable groove is inclined downwardly toward the locking hole, when the external force by which the base assembly is pivoted in left/right directions is removed (i.e., pulling back), the base assembly is automatically swerved in a straight direction instantly the locking piece is automatically guided to the locking hole and locked therein. Hence, since a user doesn't need to swerve intentionally the push stick assembly, the steam cleaner can be conveniently used.

BRIEF DESCRIPTION OF THE INVENTION

Figure 5A:
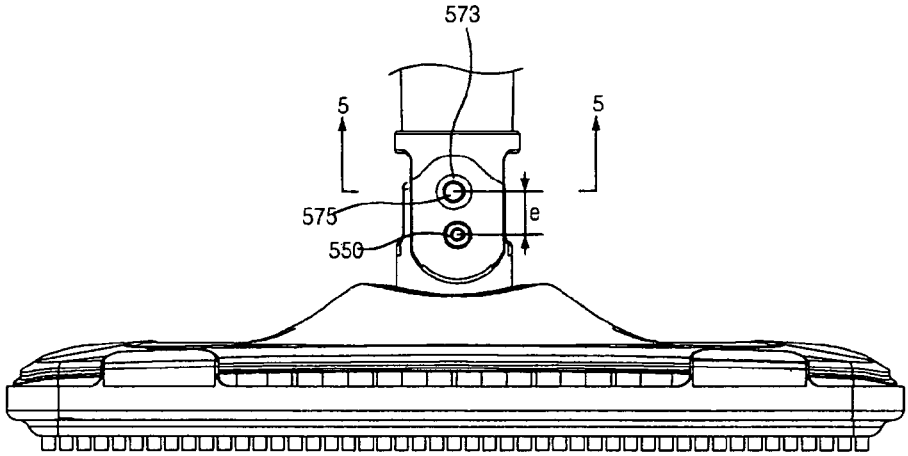
Figure 5B:
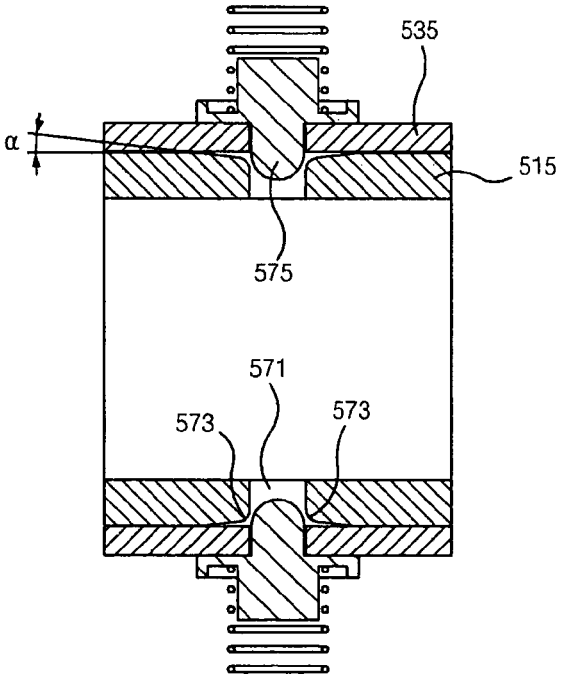

FIGS. 5*a* and 5*b* are front and cross-sectional views showing a locked eccentric member.

Figure 6A:
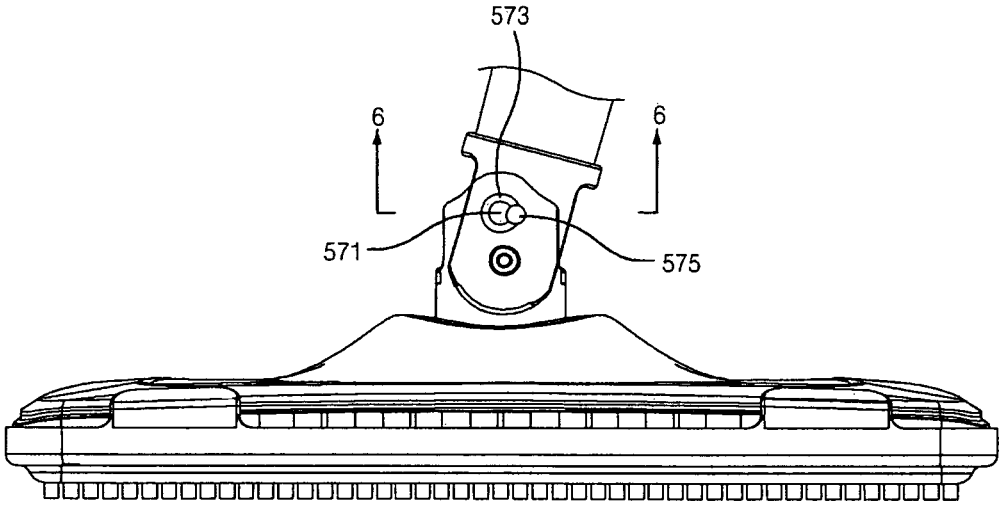
Figure 6B:
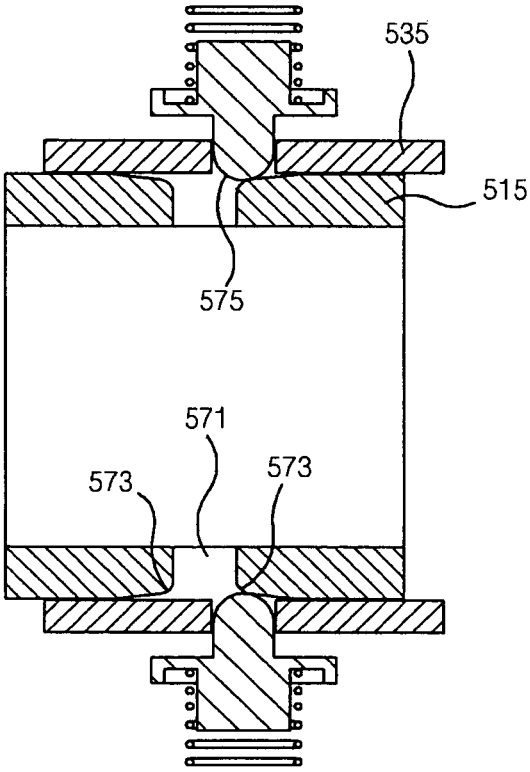

FIGS. 6*a* and 6*b* are front and cross-sectional views showing an eccentric member pivoted in a right direction.

Figure 7A:
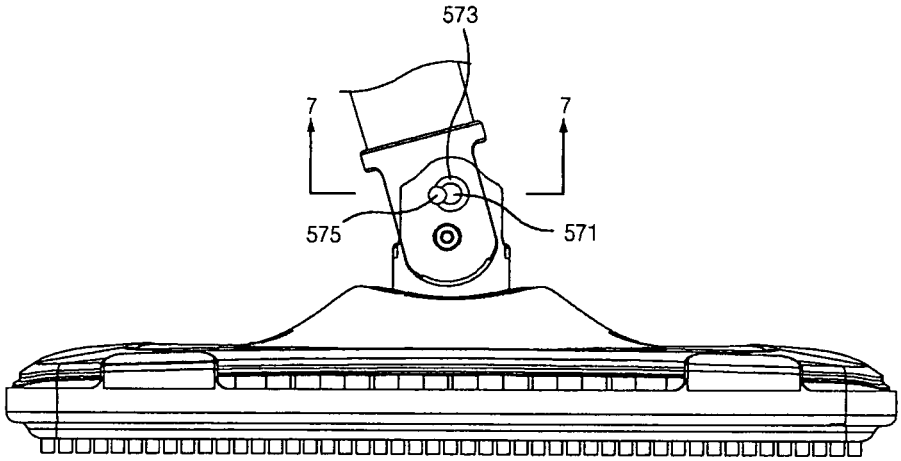
Figure 7B:
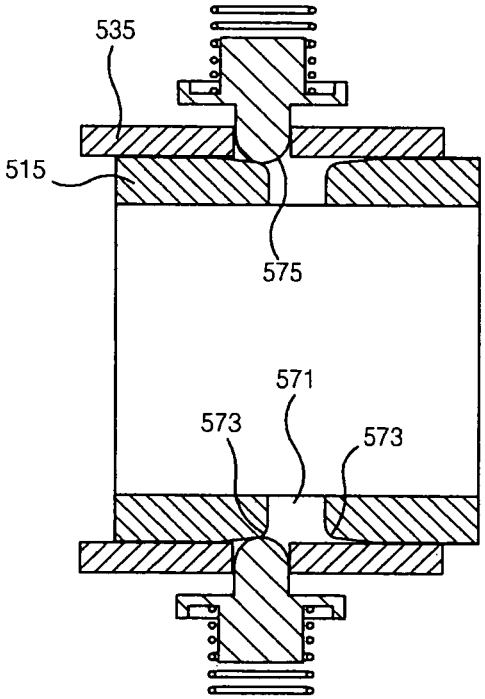

FIGS. 7*a* and 7*b* are front and cross-sectional views showing an eccentric member pivoted in a left direction.

Figure 1:
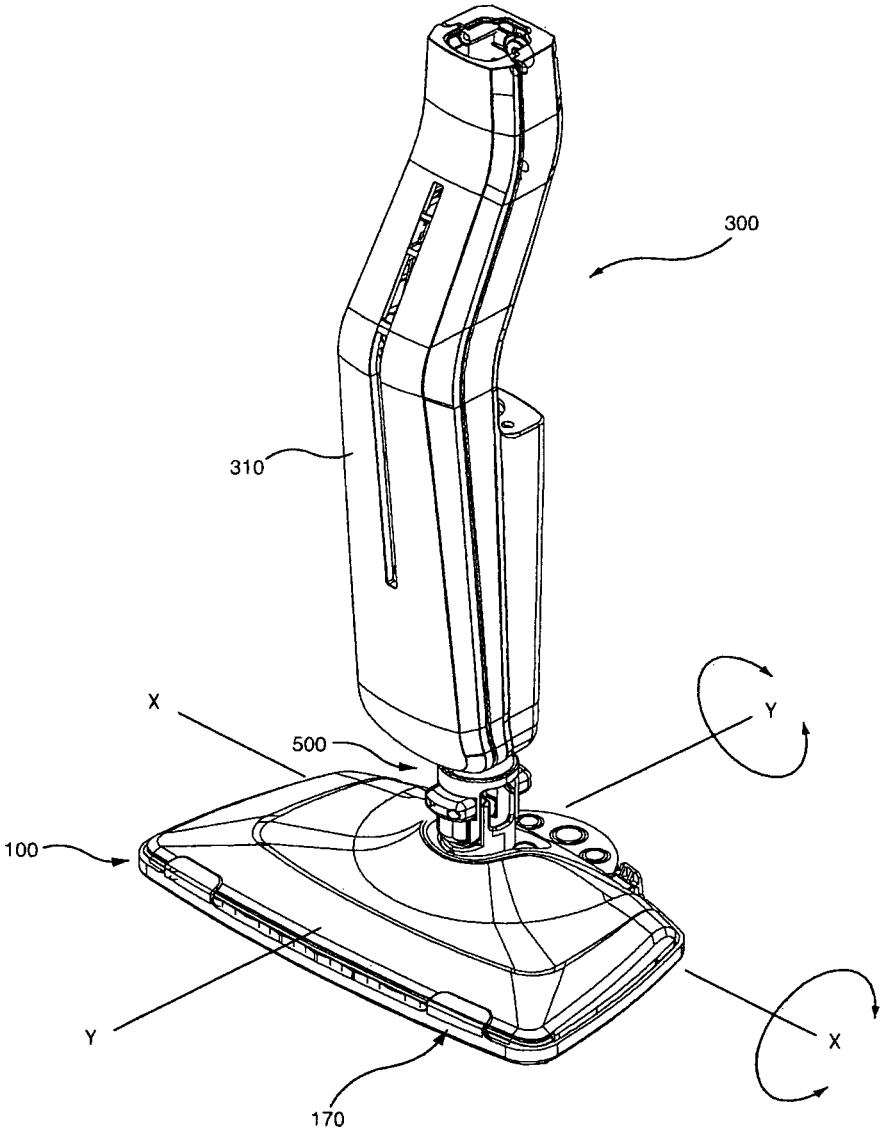
FIG. 1 is a projective view of a steam cleaner according to a preferable embodiment of this invention.
Figure 8:
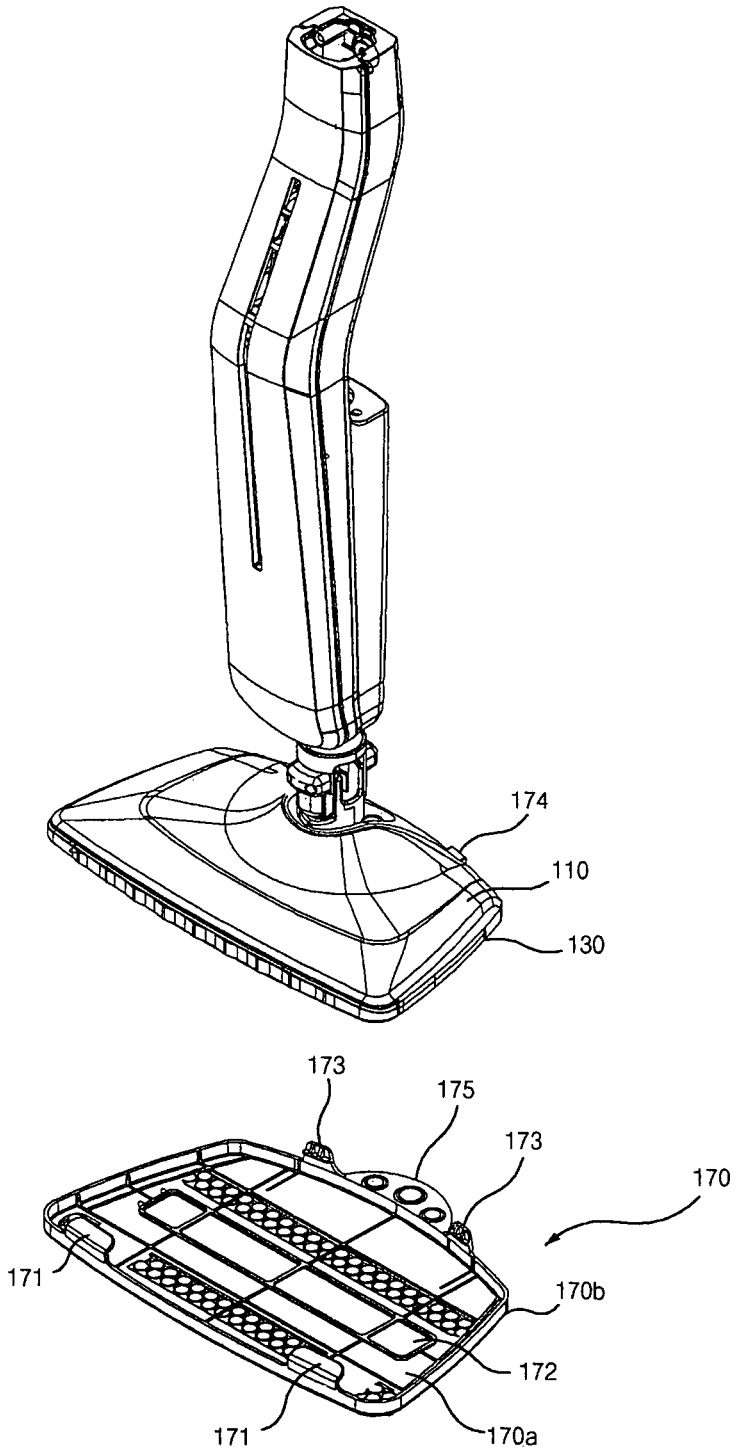
Figure 9:
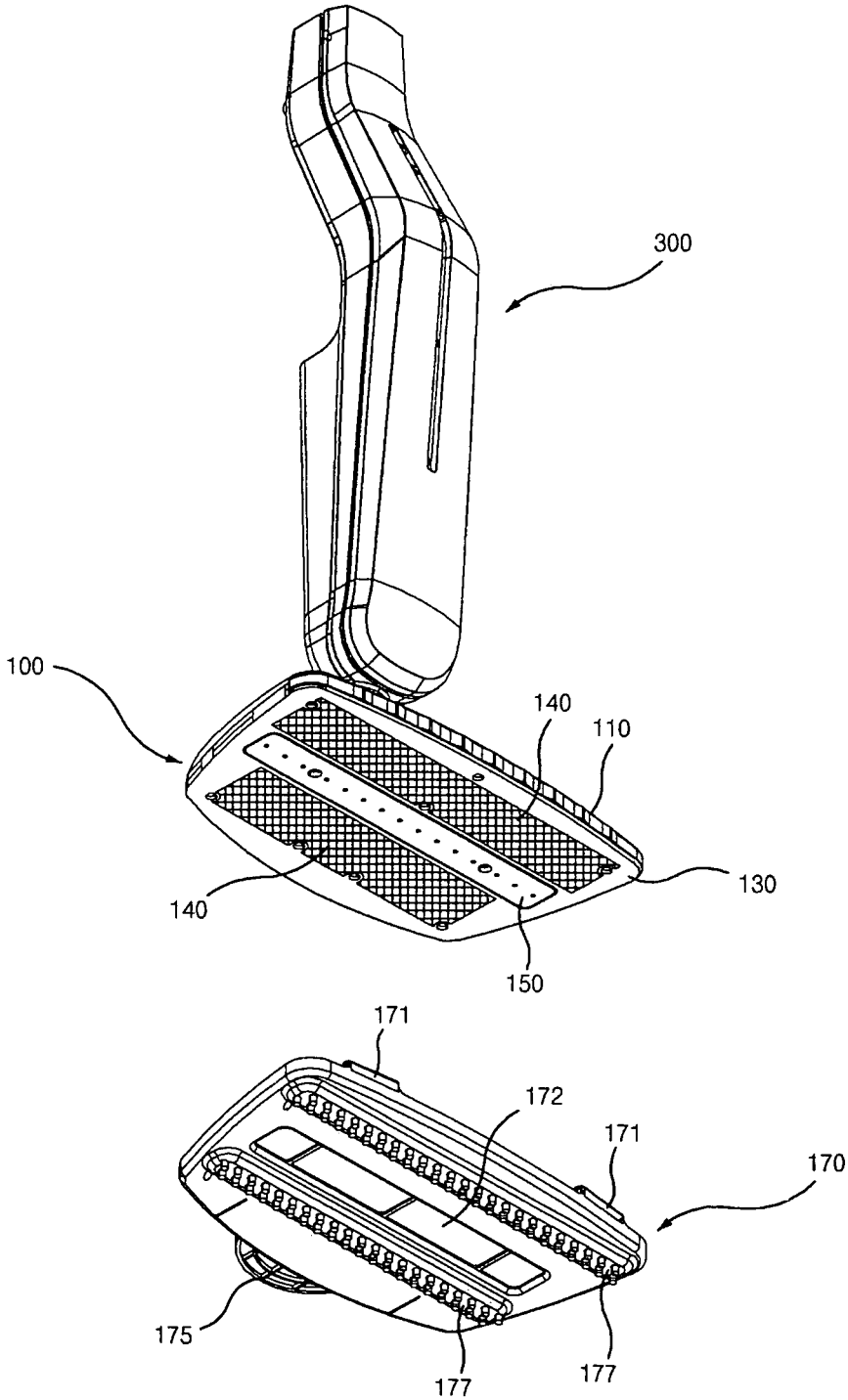

FIGS. 8 and 9 are top and bottom projective views showing a brush tray removed from FIG. 1.

Figure 10:
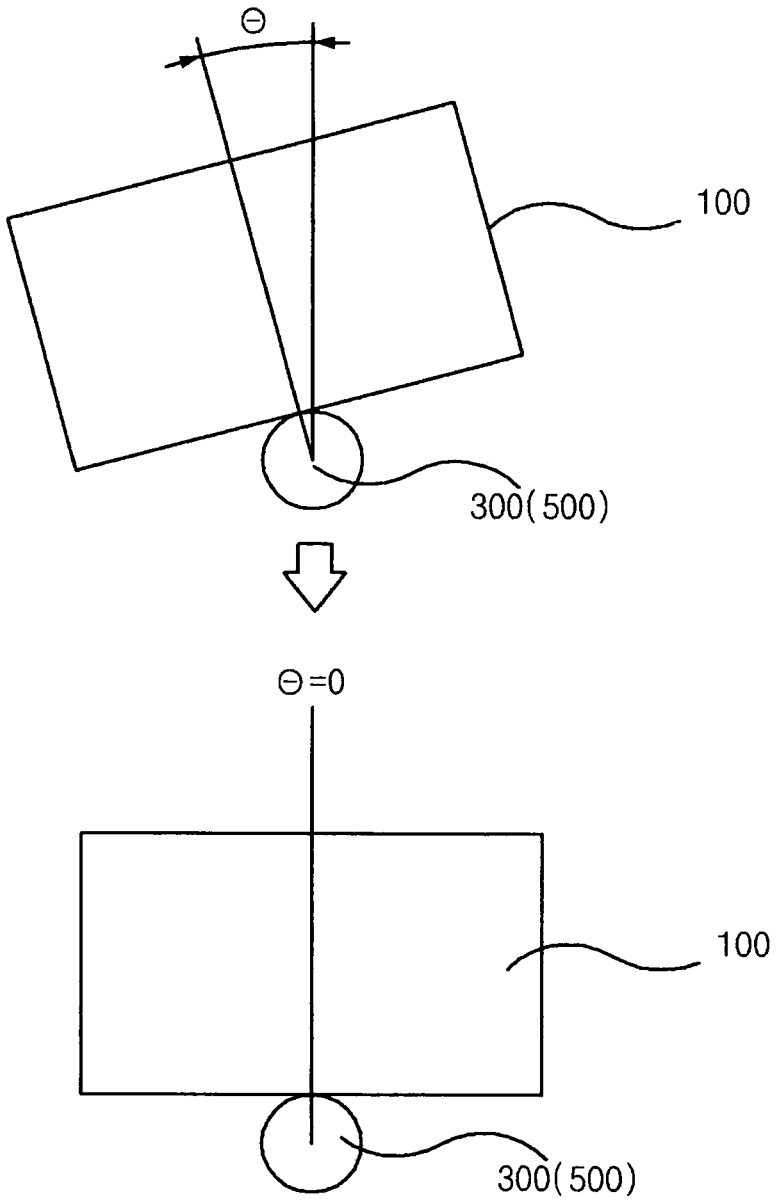

FIG. 10 is a schematic view showing that a base assembly is automatically adjusted in a straight direction when pulling back the swerved base assembly according to this invention.

Figure 11:
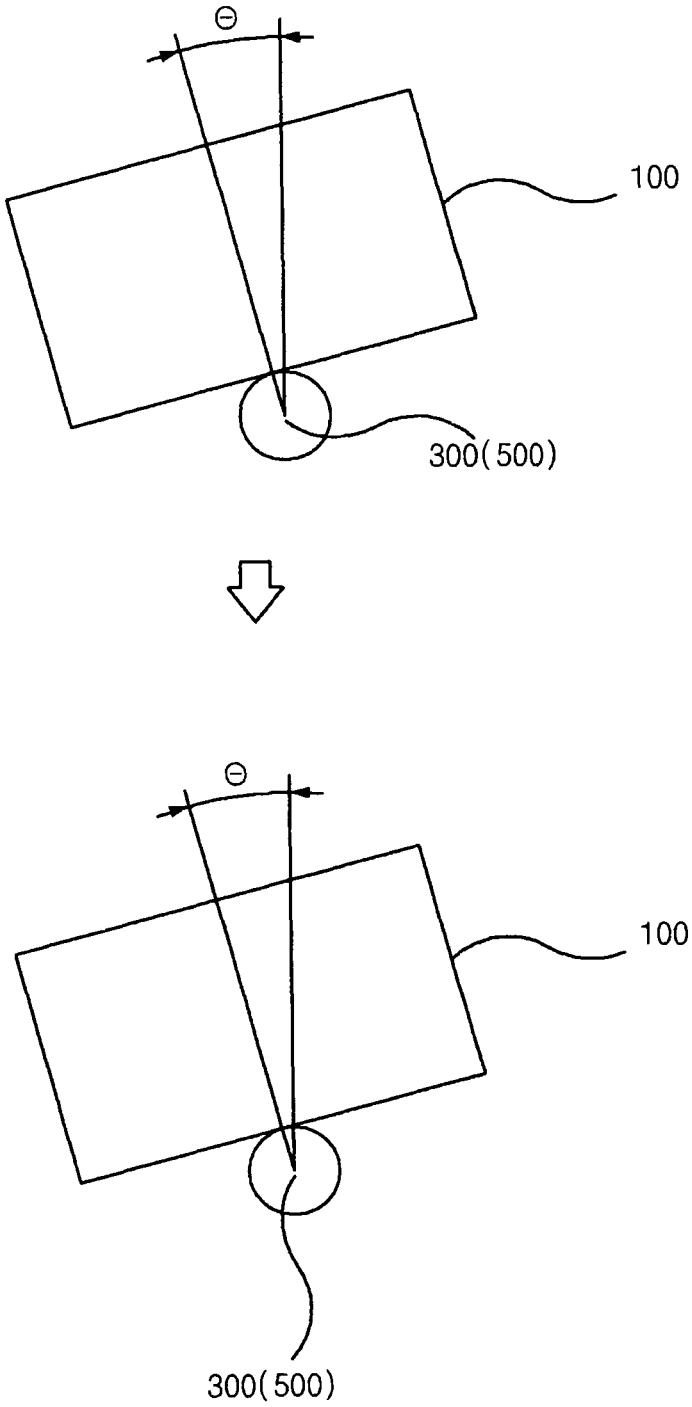

FIG. 11 is a schematic view showing that a base assembly is still swerved when pulling back the swerved base assembly according to the conventional art.

DETAILED DESCRIPTION OF THE INVENTION

In the following, preferable embodiments according to this invention will be described with reference to the accompanying drawings.

Figure 2:
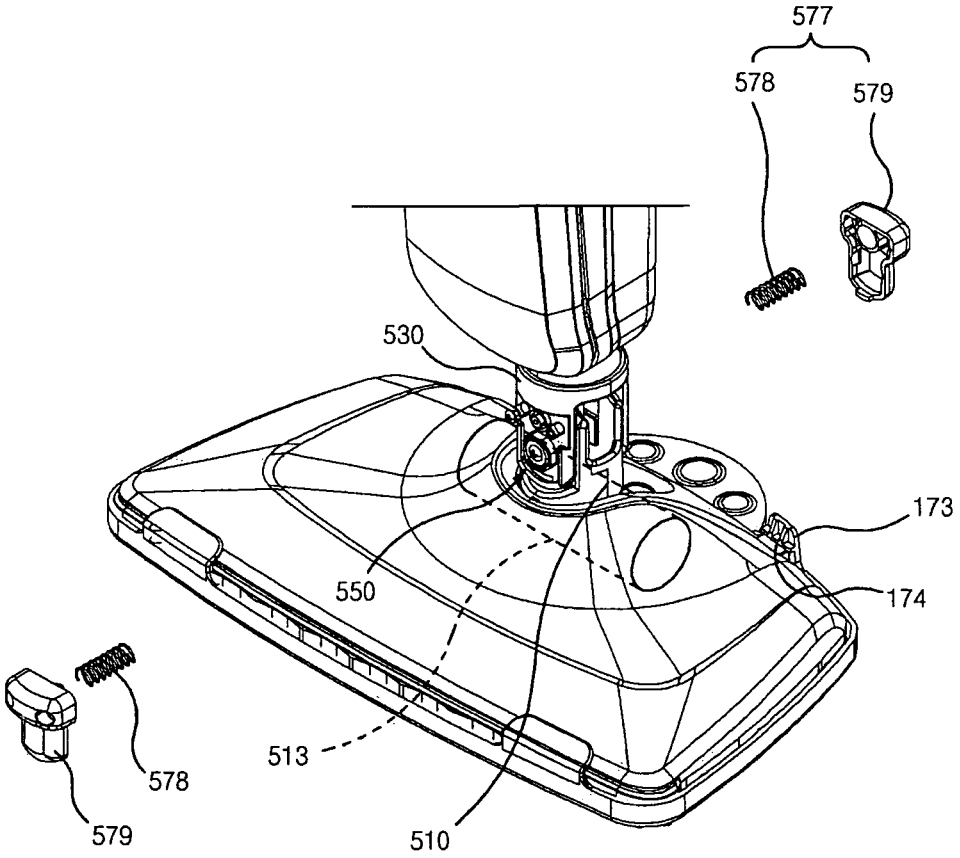
FIG. 2 is a projective view showing a sheet cover removed from a hinge assembly of FIG. 1.
Figure 3:
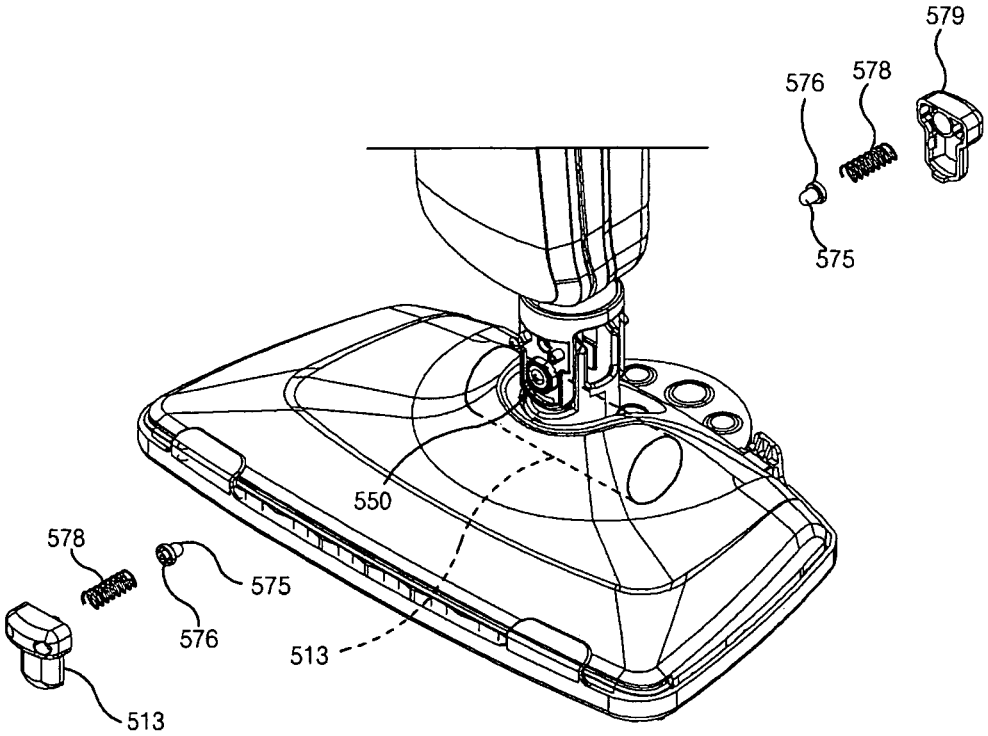
FIG. 3 is a projective view showing a spring and locking piece removed from FIG. 2.
Figure 4:
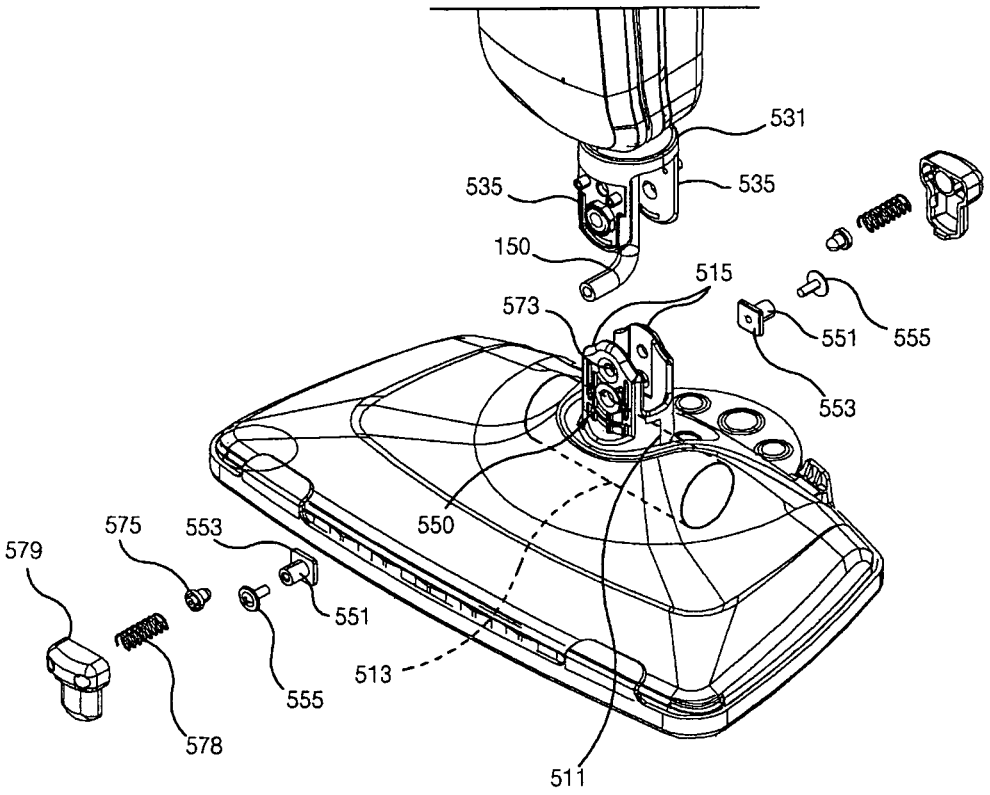
FIG. 4 is a projective view showing a left and right pivoting center axis member removed from FIG. 3.

FIG. 1 is a projective view of a steam cleaner according to a preferable embodiment of this invention; FIG. 2 is a projective view showing a sheet cover removed from a hinge assembly of FIG. 1; FIG. 3 is a projective view showing a spring and locking piece removed from FIG. 2; FIG. 4 is a projective view showing a left and right pivoting center axis member removed from FIG. 3; FIGS. 5*a* and 5*b* are front and cross-sectional views showing a locked eccentric member; FIGS. 6*a* and 6*b* are front and cross-sectional views showing an eccentric member pivoted in a right direction; FIGS. 7*a* and 7*b* are front and cross-sectional views showing an eccentric member pivoted in a left direction; FIGS. 8 and 9 are top and bottom projective views showing a brush tray removed from FIG. 1; FIG. 10 is a schematic view showing that a base assembly is automatically adjusted in a straight direction when pulling back the swerved base assembly according to this invention.

As shown in FIGS. 1 to 4, the steam cleaner according to a preferable embodiment of this invention comprises base assembly 100, push stick assembly 300, and hinge assembly 500 by which base assembly 100 is connected to push stick assembly 300.

Base assembly 100 comprises a body having upper case 110 and lower case 120, steam jet 130 formed on bottom plate 121 of lower case 120, and pad attachment protrusion 140 molded on the lower surface of bottom plate 121 in front and rear portions of steam jet 130.

Push stick assembly 300 comprises housing 310 in which a steam-generating member (non shown) for supplying steam to steam jet 130 is mounted, and a handle rod (not shown) fitted on the top end of housing 310.

Hinge assembly 500 comprises first member 510 fitted in base assembly 100, second member 530 fitted in push stick assembly 300, left and right pivoting center axis member 550 by which first member 510 is connected to second member 530, and eccentric member 570 fitted in parallel eccentrically to left and right pivoting center axis member 550, as major components.

First member 510 has first tube 511, front and rear pivoting center axis 513 formed protrusively at the lower left and right sides of first tube 511, and a pair of first arms 515 protruded upwardly at the upper front and rear portions of first tube 511.

Front and rear pivoting center axis 513 is a centric support axis allowing a pivot about X axis in front and rear directions, and supports the coupled upper case 110 and lower case 120.

Front and rear pivoting center axis 513 is fitted within base assembly 100. When a steam clear is kept in standing, base assembly 100 and first tube 511 are interlocked such that they cannot be pivoted backward (in use, if a little force is applied backward, the locked state is unlocked).

Front and rear pivoting center axis 513 may be integrally formed with first tube 511 by an injection molding method, or it may be coupled with first tube 511 as an separate part.

Second member 530 has second tube 531, and a pair of second arms 535 protruded downwardly at the upper front and rear portions of second tube 531.

Second arm 535 is placed on the outer surface of first arm 515 and telescoped on first arm 515. The first and second arms are supported by left and right pivoting center axis member 550 such that they can be pivoted about Y axis in left/right directions.

Left and right pivoting center axis member 550 has left and right pivoting center axis 551, flange 553 formed at the rear end of left and right pivoting center axis 551, and screw 555 coupled at the front end of left and right pivoting center axis 551.

When left and right pivoting center axis 551 is telescoped into first arm 515 from the inner side to the outer side of first arm 515, flange 553 is stopped at the inner side of first arm 515, and coupled using screw 555 at the front end of left and right pivoting center axis 551 inserted through first arm 515 and second arm 535.

According to this constitution, tube 150 for supplying steam passes through first and second members 510 and 530, and is connected to steam jet 130 of base assembly 100. That is, no obstruction (for example, left and right and/or front and rear pivoting center axis, eccentric member, and the like) is inside first and second members 510 and 530.

Eccentric member 570 is spaced-apart at an eccentric distance (e) above left and right pivoting center axis 551. Hence, when first and second members 510 and 530 are in line in a longitudinal direction (see FIGS. 5*a* and 5*b*), a left/right directional pivoting action is locked. In addition, when an external force is applied to the locked state, the left/right directional pivoting action is automatically unlocked and allowed (see FIGS. 6*a*, 6*b*, 7*a* and 7*b*). These actions are automatically adjusted.

Eccentric member 570 comprises locking hole 571 formed in first member 510; left and right pivotable groove 573 connected to locking hole 571; locking piece 575 fitted slidably in second member 530; and elastic portion 577 imparting elasticity to locking piece 575.

Flange 576 is formed at the front side of locking piece 575. The flange obstructs the locking piece, and acts as one side's sheet for spring 578 as described below.

Elastic portion 577 has spring 578, and sheet cover 579, and the sheet cover acts as the other side's sheet for spring 578.

In addition, left and right pivotable groove 573 may preferably be inclined (at a angle) downwardly toward locking hole 571.

Eccentric member 570 as described above will exhibit functions and effects as follows:

First, as shown in FIGS. 5*a* and 5*b*, when a steam cleaner is kept in standing, or pushed or pulled in a straight direction (i.e., the first and second members are in line in a longitudinal direction), locking piece 575 is inserted in locking hole 571, and a left/right directional pivoting action is locked.

However, if base assembly 100 bumps against an obstruction during the use of steam cleaner, the base assembly is swerved at θ angle (see FIG. 10), in a right direction as shown in FIGS. 6*a* and 6*b*, or a left direction as shown in FIGS. 7*a* and 7*b*.

That is, base assembly 100 and first member 510 is simultaneously swerved to position locking piece 575 into left and right pivotable groove 573.

Thus, a need of locking or unlocking a fixing member is omitted, and the locked state is automatically unlocked by eccentric member 570. This makes the use of steam cleaner very convenient.

Then, if the counter force from the obstruction is removed by pulling back the steam cleaner in the swerved state, locking piece 575 positioned in left and right pivotable groove 573 inclined tends to return to locking hole 571, which was its original position, resulting in enabling an automatic lock.

By this automatic locking action, a left/right directional pivoting action is locked, and base assembly 100 is positioned in a straight direction. Hence, a user doesn't need to swerve base assembly 100 or push stick assembly 300.

In case of the prior art, a user should swerve base assembly 100 in a right position, and then push it in front/rear directions, since it is not easy to push base assembly 100 in a swerved state. According to this invention, this annoying work may be omitted.

Preferably, tray 170 with brush 177 may be additionally fitted, as shown in FIGS. 9 and 10. The brush may be used to rub a floor such as tile.

Tray 170 may be removed when cleaning a wooden floor using a steam cleaner, and it may be fitted in base assembly 100 when cleaning a badly stained concrete or tile floor using the steam cleaner.

Tray 170 has tray plate 170*a*, a tray frame with rim 170*b* protruded slightly upwardly around tray plate 170*a*, steam jet through-hole 172 formed in tray plate 170*a*, and brush 177 formed on the lower surface of tray plate 170*a*.

Steam jet through-hole 172 may preferably be placed below steam jet 130.

Further, the tray frame with brush 177 covers pad attachment protrusion 140, and thus it acts to prevent damages due to friction with a rigid floor.

Tray 170 is removably attached to base assembly 100 using removable members.

The removable members include front removable piece 171 and rear removable pieces 173 and 174.

Front removable piece 171 is formed protrusively at the front left and right sides of the tray frame, exactly from the front left and right sides of rim 170*b* toward the rear. When it is coupled with upper case 110, it acts to press and hold the front top surface of upper case 110.

Rear removable pieces 173 and 174 has rear removable engaged piece 173 protruded upwardly at the rear left and right sides of the tray frame, exactly the rear left and right sides of rim 170*b* toward the upside, and rear removable and engaged stopping piece 174 formed at the rear side of upper case 110 and engaged with rear removable and engaged protruding piece 173.

Preferably, rear removable and engaged protruding piece 173 has elastic property, and it may be bended backward until it is engaged with rear removable and engaged stopping piece 174. That is, rear removable and engaged protruding piece 173 acts to press and hold upper case 110 such that the upper case is not raised upwardly.

By using these removable members, rear removable and engaged stopping piece 174 is engaged with rear removable and engaged protruding piece 173 while piece 174 pushes back slightly the piece 173 and falls down, and their coupling is completed, by a series of operations that base assembly 100 is first slightly bended forward, is coupled with front removable piece 171, and then is stood perpendicularly.

In the state that two pieces is coupled, tray 170 may be removed by lifting up push stick assembly 300 while pressing plate 175 using foot. By this work, rear removable and engaged stopping piece 174 is pivoted about front removable piece 171 and is unengaged with rear removable and engaged protruding piece 173. Then, tray 170 is completely removed from the base member by drawing piece 174 out of piece 173.

Thus, tray 170 may be simply coupled with the base assembly by the mechanism that the tray is surrounded and pressed at the front side and it is pressed from above at the rear side. Once the tray is coupled with the base assembly, since the tray may be removed only when a physical force is applied, it tray may be stably used (the base assembly with the tray attached has a double structure by which the tray should be drawn out upwardly at the rear side, and in a sharp angle direction at the front side. Therefore, since the tray is held in the front side when pulling a steam cleaner, and is held in the rear side when pushing it, the tray cannot easily be removed from the base assembly)

While this invention has been shown and described in connection with the preferably embodiments, it will be apparent to those skilled in the art that modifications and variations can be made without departing from the spirit and scope of the invention as defined by the appended claims.

For example, contrary to the embodiment described above, it will be appreciated that an eccentric member may be fitted in a hinge assembly having a first member with a left and right pivoting center axis and a second member with a front and rear pivoting center axis.

The hinge assembly according to this invention may be applied to any article having front/rear and left/right directional pivoting mechanisms.

The description of numerical numbers:

| | |
|---|---|
| 100: base assembly | 110: upper case |
| 120: lower case | 121: bottom plate |

-continued

| The description of numerical numbers: | |
|---|---|
| 130: steam jet | 140: pad attachment protrusion |
| 150: tube | 170: tray |
| 170a: tray plate | 170b: rim |
| 171: front removable piece | 172: steam jet through-hole |
| 173, 174: rear removable piece | |
| 173: rear removable and engaged protruding piece | |
| 174: rear removable and engaged stopping piece | |
| 175: pressing plate | 177: brush |
| 300: push stick assembly | 310: housing |
| 500: hinge assembly | 510: first member |
| 511: first tube | 513: front and rear pivoting center axis |
| 515: first arm | 530: second member |
| 531: second tube | 535: second arm |
| 550: left and right pivoting center axis member | 551: left and right pivoting center axis |
| 553: flange | 555: screw |
| 570: eccentric member | 571: locking hole |
| 573: left and right pivotable groove | 575: locking piece |
| 576: flange | 577: elastic portion |
| 578: spring | 579: sheet cover |

The invention claimed is:

1. A steam cleaner, comprising:

(i) a hinge assembly comprising:

an upper hinge member comprising two downward extending pivot arms each having an at least substantially planar configuration and a longitudinal axis, the two downward extending pivot arms being spaced apart and at least substantially parallel to each other, a lower hinge member comprising two upwardly extending pivot arms each having an at least substantially planar configuration and a longitudinal axis and the two upwardly extending pivot arms being spaced apart and at least substantially parallel to each other, wherein each of the downward extending pivot arms is pivotably attached to one of the upward extending pivot arms by a different pivot member, the different pivot members sharing a common pivot axis transverse to the at least substantially planar configuration, with distal portions of the upwardly extending and downwardly extending pivot arms overlapping and being in parallel plane juxtaposition with each other to form two spaced apart pivotably attached pairs of parallel juxtaposed upwardly extending and downwardly extending pivot arms defining an unobstructed central longitudinally extending space there between, wherein for each of the pivotably attached pairs of parallel juxtaposed upwardly extending and downwardly extending pivot arms each of the pivot arms has formed therein a hole having a central axis transverse to the planar configuration, the holes mutually disposed such that when the longitudinal axes of the pivots arms are parallel, the holes have a single central axis that is parallel with and eccentric to the pivot axis, and wherein the hinge assembly comprises for each pair of parallel juxtaposed upwardly extending and downwardly extending pivot arms, a spring-loaded bolt member sized and configured to protrude automatically into both holes of the pair of parallel juxtaposed upwardly extending and downwardly extending pivot arms when the longitudinal axes of the pivot arms are parallel thereby reversibly locking the pivot arms in position and to release the pivot arms from the locked position upon the application of sufficient external force;

(ii) an upper portion comprising a housing and a push stick, wherein the push stick is connected to the upper hinge member;

(iii) a base having a top side, a bottom side, a front side, a back side, a left side and a right side, wherein the top side of the base is connected to the lower hinge member; and (iv) a steam delivery tube passing from the upper portion through the central space of the hinge assembly into the base.

2. The steam cleaner of claim 1, wherein the upward extending pivot arms of the hinge assembly are disposed between the downward extending pivot arms of the hinge assembly.

3. The steam cleaner of claim 1, wherein the base further comprises a steam jet disposed on the bottom side of the base and the steam delivery tube is connected to the steam jet.

4. The steam cleaner of claim 3, wherein the upward extending pivot arms of the hinge assembly are disposed between the downward extending pivot arms of the hinge assembly.

* * * * *